United States Patent [19]

Andrianov et al.

[11] 3,947,366

[45] Mar. 30, 1976

[54] SIZE FOR TEXTILE YARNS AND METHOD OF SIZING THEREOF

[76] Inventors: Kuzma Andrianovich Andrianov, Vystavochny pereulok 3, kv. 9; Lev Ivanovich Gandurin, Kotelnicheskaya naberezhnaya, 25/8, kv. 33a, both of Moscow; Alexandra Fedorovna Davydova; Vyacheslav Ivanovich Sidorov, both of ulitsa Glavmosstroya, 1, kv. 14, Moskovskaya oblast, Solntsevo, all of U.S.S.R.

[22] Filed: July 27, 1973

[21] Appl. No.: 383,455

[52] U.S. Cl. ..... 252/8.6

[51] Int. Cl.[2] ..... D06M 11/02

[58] Field of Search 252/8.6; 260/29.6 NR, 29.6 M; 117/139.5 CQ, 139.5 A

[56] References Cited

UNITED STATES PATENTS

| | | | |
|---|---|---|---|
| 3,464,947 | 9/1969 | Robertson et al. | 260/29.6 |
| 3,491,051 | 1/1970 | Elkin et al. | 260/29.6 |
| 3,677,810 | 7/1972 | Campbell et al. | 427/387 |

*Primary Examiner*—Donald E. Czaja
*Assistant Examiner*—Earl A. Nielsen
*Attorney, Agent, or Firm*—Haseltine, Lake & Waters

[57] ABSTRACT

A textile size containing the following components, parts by weight:

1. An oligomeric acrylic acid with a molecular weight within the range of from 3,000 to 30,000: 3.0–15.0;
2. Siloxanolates of alkali metals of the formula:

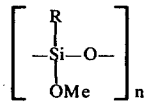

wherein R is an alkyl group, Me is an alkali metal, $n$ is an integer of from 3 to 10: 0.01–0.7.

This composition ensures good adhesion of the oligomeric acrylic acid to synthetic, and particularly to polyamide, filaments.

This composition may incorporate 0.01 to 0.3 parts by weight of potassium-phosphorylated polyglycol ether of higher aliphatic alcohol of the formula: $RO(CH_2CH_2O)_nPOOK$, wherein R is an alkyl group containing 8–10 carbon atoms, and $n$ = 5–6. This component, when present in the size, improves the antistatic properties of yarns.

A method of sizing textile yarns comprises treatment of said yarns with a 3–15% aqueous solution of the size of the above composition.

5 Claims, No Drawings

SIZE FOR TEXTILE YARNS AND METHOD OF SIZING THEREOF

The present invention relates to the textile industry. More particularly it relates to process technology employed in textile production and more specifically to a method of sizing and to size compositions.

To increase the cohesion of yarns when they are processed in weaving, the yarns are slightly twisted or protected by applying coatings thereon. Such coatings are referred to as textile sizes, while the process of applying them is referred to as sizing.

Known in the art is a textile size based on starch and derivatives thereof, which is employed for sizing hydrophilic natural yarns, but it cannot be employed for sizing hydrophobic synthetic yarns due to a low adhesion of the size to the yarns.

For this reason, it has become necessary to provide novel synthetic polymer compositions for sizing synthetic continuous filament and spun yarns which would feature improved adhesive properties.

Disclosure has been made in the prior art of a textile size based on polymeric mono- and dicarboxylic acids and useful for sizing in the form of aqueous solutions. However, synthetic yarns treated with this size are electrified during weaving to such an extent that their further processing appears to be impossible without an additional technological operation of oiling or antistatic treatment.

Also known in the art is the use of acrylic polymers for sizing textile yarns. These compositions, as a rule, are rather complicated and contain, in addition to a basic acrylic polymer, various additives such as lubricants, antistatic agents, swelling agents, etc.

It has also been proposed to make use of polymethacrylic acid partly neutralized with an alkali and plasticized with a polyoxyethylene condensate of lipophilic organic compounds. Such a size is employed in the form of aqueous solutions with a pH ranging from 4.5 to 6. This composition has proved effective in the sizing of synthetic yarns (viscose, acetate), but it is unsuitable for sizing polyamide yarns, the maximum take-up capacity of polyamide yarns is observed at a pH below 3.

Known in the art is the use, for sizing staple yarn made of polyester, acrylic or cellulose filaments (or blends thereof), of an aqueous solution of a copolymer of acrylic acid and an acrylate salt taken in a ratio of 1:0.3 to 1:6, respectively, the solution pH being 4.0 to 6.5.

For sizing textile materials (continuous filament and other yarns) use is made of acrylic copolymers neutralized with ammonium hydroxide and alkali metal hydroxides mixed with derivatives of starch, polyvinyl alcohol, or other additives (swelling agents, lubricants, etc.). This composition comprises:

1. a copolymer of the following composition: 5 to 20 mol.% of acrylic (methacrylic) acid, 80–95 mol.% of an acrylate (methacrylate) of aliphatic alcohols containing 1 to 18 carbon atoms 1% to 20% by weight;
2. an additive (polyvinyl alcohol, starch, polyethylene oxide, etc: 1 to 50% by weight of the copolymer.

This composition is also employed in the form of aqueous solutions.

A major disadvantage inherent in such complicated compositions used for sizing synthetic yarns resides in their instability when stored or exposed to elevated temperatures.

Such a multi-component polymer size separates, coagulates, and becomes unsuitable for application.

Another major disadvantage of such a size resides in the relatively high viscosity of sizing solutions at small concentrations of the principal component, whereby the penetration of the sizing solution and bonding of synthetic yarns are unsatisfactory.

It is an object of the present invention to provide a size composition which will ensure satisfactory adhesion thereof to synthetic yarns (polyamide, polyester, viscose, acetate, and the like).

Another object of the present invention is to provide a size composition which will ensure improved penetration properties of an aqueous solution thereof.

Still another object of the present invention is to provide a size composition which will be characterized by an adequate antistatic effect.

Yet another object of the present invention is to provide a size composition which will retain its properties in storage or during the technological process of sizing.

And, finally, it is an object of the present invention to provide a method of sizing synthetic yarns.

These objects are attained by providing a textile size based on a polymeric carboxylic acid which, according to the present invention, includes the following components, in parts by weight:

1. an oligomeric acrylic acid with a molecular weight of 3,000 to 30,000: 3.0 to 15.0;
2. siloxanolates of alkali metals of the formula:

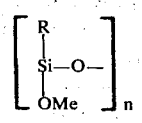

The presence of an alkali metal siloxanolate in the size composition increases the adhesiveness of the oligomeric acrylic acid to synthetic yarns, plasticizes the size film, and decreases the viscosity of an aqueous solution of the composition. The presence, in the size composition, of said compound ensures an increase in the oligomeric acrylic acid adhesiveness to polyamide yarns 3 times, to polyester yarns, 2 times, acetate and viscose yarns, 1.5–2.5 times.

To improve the antistatic properties of synthetic yarns to be sized, the size is mixed with postassium-phosphorylated polyglycol ethers of higher aliphatic alcohols of the formula: $RO(CH_2CH_2O)_n$ POOK, wherein R is an alkyl group having 8 to 10 carbon atoms, $n$ ranges from 5 to 6, in an amount of 0.01 to 0.03 parts by weight.

The aqueous sizing solution prepared from the above-mentioned composition readily penetrates between individual filaments forming a continuous filament yarn, whereby effective bonding of the latter is ensured, while the sticking of individual filaments to one another during the sizing process is precluded.

The size of the present invention may have the following embodiments:

I. Textile size comprising:

1. an oligomeric acrylic acid with a molecular weight within the range of from 3,000 to 30,000: 3.0 to 8.0 parts by weight;

2. A siloxanolate of an alkali metal of the formula:

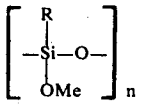

wherein R is $CH_3$ or $C_2H_5$, Me is K or Na; $n = 4$–6: 0.03 to 0.3 part by weight.

II. Textile size preferably intended for polyamide continuous filament and spun yarns consisting of the following components, parts by weight:

1. An oligomeric acrylic acid with a molecular weight within the range of from 3,000 to 30,000: 3.0;
2. An alkali metal siloxanolate of the formula:

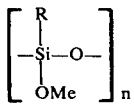

wherein R is $CH_3$ or $C_2H_5$; Me is K or Na; $n = 4$–6: 0.03 to 0.003.

3. A potassium-phosphorylated polyglycol ether of the formula: $RO(CH_2—CH_2—O)_nPOOK$, wherein R is an alkyl group with 8 to 10 carbon atoms, $n = 5$–6: 0.01 to 0.02.

III. Textile size for viscose and acetate continous filament spun yarns having the following components, parts by weight:

1. An oligomeric acrylic acid with a molecular weight within the range of from 3,000 to 30,000: 3.0
2. Sodium ethylsiloxanolate: 0.4.

The present invention ensures efficient sizing of synthetic yarns (including blended yarns) by means of aqueous solutions of the above-mentioned compositions using conventional equipment to produce high-quality sized yarns. The present invention also makes it possible to increase the output of looms 3–5%.

Products included in the size composition are readily available and manufactured by the chemical industry.

The oligomeric acrylic acid as used in the present invention is prepared by a method of free-radical telomerization of an acrylic acid monomer using, as telogens, benzene, isopropylbenzene and thioglycolic acid, and an initiator.

The size of the above composition is prepared by dissolving components in the above-mentioned ratios in 100 parts by weight of water at a temperature within the range of 40° to 50°C with stirring.

The method of sizing synthetic yarns according to the present invention involves treatment of said yarns with a 3–15% aqueous solution of the size of the above composition using sizing machines continuously by dipping or "knip size", the sizing solution temperature ranging from 50° to 70°C.

Drying of sized yarns is effected by contact or other methods, the temperature in the first and second drying means being 60°C, in the third and fourth drying means 80°C and in the fifth drying means, 60°C.

Subjected to sizing are filaments or yarns of viscose, acetate rayon, polyvinyl-chloride, and preferably polyamide.

The size may be easily removed from yarns by scouring with water at a temperature within the range of from 40° to 60°C using no surfactants.

For a better understanding of the present invention, the following Examples illustrating specific embodiments of the size composition and method of sizing various synthetic filaments are given hereinbelow.

EXAMPLE 1

This Example illustrates the following size composition (amounts of components are expressed as parts by weight) and method of sizing polyamide yarns:

| | |
|---|---|
| Oligomeric acrylic acid with a molecular weight of 7,000 | 3.0 |
| Sodium ethylsiloxanolate | 0.03 |

Said sizing composition is prepared by stirring said components in 100 parts by weight of water at a temperature of from 40° to 50°C for a period of 10 to 15 minutes until completely dissolved.

Polyamide continuous filament yarns twisted to 200 twists per meter are treated with the sizing composition on multi-cylinder sizing machines by dipping at a sizing solution temperature of 60°C. The size concentration in the sizing bath is 3%; pH = 2.6; squeezing roller pressure is 10–15 kg/cm².

The sized yarns are dried by a contact method at a temperature of the first and second drying cylinders of 60°C; the third and fourth cylinders of 80°C, and the fifth drying cylinder of 60°C. Stretching is 3–5%.

EXAMPLE 2

This Example illustrates the following size composition (amounts of components are expressed as parts by weight) and method of sizing polyamide yarns:

| | |
|---|---|
| Oligomeric acrylic acid with a molecular weight of 7,000 | 5.0 |
| Sodium ethylsiloxanolate | 0.06 |
| Potassium-phosphorylated pentaethylene glycol ether of octyl alcohol | 0.02. |

Said composition is used for the preparation of 100 parts by weight of a sizing solution (in accordance with the procedure described in Example 1). Polyamide continuous filament yarns with a low twist (up to 40 twists per meter) are treated with the sizing composition on sizing machines by dipping at a sizing solution temperature of 60°C. The size concentration in the bath is 5%; pH = 2.6; pressure of squeezing rollers is 20–25 kg/cm².

Drying of sized yarns is effected by a contact method at a temperature of the first and second drying cylinders of 60°C, third and fourth cylinders of 80°C, and fifth cylinder of 60°C stretching is 3–5%.

EXAMPLE 3

This Example illustrates the following size composition (amounts of components are given in parts by weight) and method of sizing viscose yarns:

| | |
|---|---|
| Oligomeric acrylic acid with a molecular weight of 4,000 | 3.0 |

-continued

| | |
|---|---|
| Sodium methylsiloxanolate | 0.3. |

This composition is used for the preparation of 100 parts by weight of a sizing solution (in accordance with the procedure described in Example 1). The treatment of viscose yarns with the sizing composition is effected on sizing machines by dipping at a sizing solution temperature of 50°C. The size concentration in the bath is 3%; pH = 6.0; the pressure of squeezing rollers is 5–10 kg/cm². Drying temperature 60°–90°C; stretching 6–7%.

EXAMPLE 4

This Example illustrates the following size composition and method of sizing acetate yarns (amounts of components are given in parts by weight):

| | |
|---|---|
| Oligomeric acrylic acid with a molecular weight of 4,000 | 3.0 |
| Sodium methylsiloxanolate | 0.3 |
| Potassium-phosphorylated hexaethylene glycol ether of nonyl alcohol | 0.01. |

This composition is used for the preparation of 100 parts of a sizing solution (according to the procedure described in Example 1). Acetate continuous filament yarns are treated with the sizing composition on sizing machines at a temperature of the sizing solution ranging from 50° to 60°C. The size concentration is 3.0%; pH = 6.5; pressure of squeezing rollers is 5–10 kg/cm². Drying temperature 55°–75°C; stretching 3–5%.

What is claimed is:

1. A textile size comprising, parts by weight:

an oligomeric acrylic acid with a molecular weight of from 3,000 to 30,000: 3.0 to 15.0 an alkali metal siloxanolate of the formula:

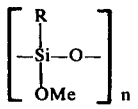

wherein R is an alkyl group, Me is an alkali metal; n *n* is 3 to 10: 0.01 to 0.1.

2. A textile size as claimed in claim 1, comprising 0.01 to 0.3 part by weight of a potassium-phosphorylated polyglycol ether of higher aliphatic alcohols of the formula: $RO(CH_2CH_2\text{-}O)_n$ POOK, group having is an alkyl group having 8–10 carbon atoms; *n* is 5–6.

3. A textile size as claimed in claim 1, comprising, in parts by weight:

an oligomeric acrylic acid with a molecular weight of from 3,000 to 30,000: 3.0 to 8.0 an alkali metal siloxanolate of the formula:

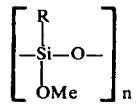

wherein R is $CH_3$ or $C_2H_5$; Me is K or Na; *n* is 4 to 6: 0.03 to 0.3.

4. A textile size as claimed in claim 2 for polyamide yarns, comprising, parts by weight:

an oligomeric acrylic acid with a molecular weight of from 3,000 to 30,000: 3.0 an alkali metal siloxanolate of the formula:

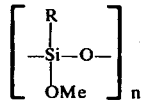

wherein R is $CH_3$or $C_2H_5$; Me is K or Na; *n* is 4 to 6: 0.03 to 0.3.

potassium-phosphorylated polyglycol ether of the formula: $RO(CH_2CH_2O)_n$ POOK, wherein R is an alkyl group having 8–10 carbon atoms, *n* is 5 to 6: 0.01 to 0.02.

5. A textile size as claimed in claim 1 for viscose and acetate filaments and yarns comprising, parts by weight:

| | |
|---|---|
| an oligomeric acrylic acid with a molecular weight of from 3,000 to 30,000 | 3.0 |
| sodium ethylsiloxanolate | 0.4 |

* * * * *